United States Patent [19]

Yoshida

[11] 4,427,845

[45] Jan. 24, 1984

[54] DYNAMIC MICROPHONE

[75] Inventor: Satoshi Yoshida, Tokorozawa, Japan

[73] Assignee: Pioneer Electronic Corporation, Tokyo, Japan

[21] Appl. No.: 283,321

[22] Filed: Jul. 15, 1981

[30] Foreign Application Priority Data

Jul. 19, 1980 [JP] Japan ..... 55-102296[U]

[51] Int. Cl.[3] ..... H04R 3/04

[52] U.S. Cl. ..... 381/94; 381/93; 179/121 D; 179/115.5 VC; 179/115.5 DV

[58] Field of Search ..... 179/1 P, 1 F, 115.5 DV, 179/1 DM, 1 MN, 121 D, 111 E, 1 VC, 1 E

[56] References Cited

U.S. PATENT DOCUMENTS 3,025,359 3/1962 Schilling et al. ..... 179/110 A
3,160,716 12/1964 Luth ..... 179/115.5 VC
4,017,694 4/1977 King ..... 179/115.5 VC
4,025,722 5/1977 Karron ..... 179/1 P
4,295,011 10/1981 Hathaway ..... 179/115.5 VC

FOREIGN PATENT DOCUMENTS 1139770 1/1969 United Kingdom ..... 179/121 D

*Primary Examiner*—G. Z. Rubinson
*Assistant Examiner*—Robert Lev
*Attorney, Agent, or Firm*—Sughrue, Mion, Zinn, Macpeak and Seas

[57] ABSTRACT

A dynamic microphone in which vibrations transmitted to the case of the microphone are cancelled over a very wide frequency range. A moving coil type microphone unit sensitive to sound and a moving coil type vibration pickup unit sensitive to vibrations transmitted to the case of the microphone are provided in the case with a common magnetic circuit. The outputs of the moving coil vibration unit are coupled to the outputs of the microphone unit in opposite phase so that noise components corresponding to the vibrations transmitted to the case are cancelled.

11 Claims, 4 Drawing Figures

DYNAMIC MICROPHONE

BACKGROUND OF THE INVENTION

The present invention relates to a dynamic microphone, more particularly to a dynamic microphone with a moving coil type microphone unit.

FIG. 1 is a conventional cross-sectional view of a dynamic microphone which has been disclosed as a means of attaining a full understanding of the present invention. In FIG. 1, a moving coil type microphone unit 2 for collecting sound is mounted on a packing 3 in a microphone casing 1 and a moving coil type vibration pickup unit 4 is also positioned therein. The moving coil type vibrating pickup unit 4 is mounted through a rubber spacer 6 to a supporting member 5 fixed to the case 1. The microphone unit 2 and the vibration pickup unit 4 are electrically connected in opposite phase in order to cancel noise components arising from vibrations transmitted to the case 1. The output signal from the microphone unit and the vibration pickup unit is coupled to output terminals *7a* and *7b*.

With such a construction, since the microphone unit 2 is disposed far from the pickup unit 4, as is apparent from FIG. 1, vibrations transmitted to the microphone case 1 will only be cancelled positively at low frequencies. Namely, for high frequencies, since there is a phase difference between outputs of the microphone unit 2 and vibration pickup unit 4, is it impossible to obtain sufficient cancellation of the noise components. Also, the prior art device of FIG. 1 requires separate magnetic circuits for the microphone unit 2 and for the vibration pickup unit 4, resulting in an increase in the number of mechanical parts and hence a high cost.

SUMMARY OF THE INVENTION

In view of the above noted defects, an object of the present invention is to provide a dynamic microphone having increased cancellation of noise components while the number of the mechanical parts is decreased.

In accordance with this and other objects of the invention, there is provided a dynamic microphone including a case, a moving coil type microphone unit sensitive to sound positioned within the case, and a moving coil type vibrating pickup unit which is sensitive to vibrations transmitted to the case. Outputs of the microphone unit and the vibration pickup unit are coupled to each other in opposite phase to one another so that noise components corresponding to vibrations transmitted to the case are cancelled. The microphone unit and the vibration pickup unit have a common magnetic circuit.

DESCRIPTION OF THE PREFERRED EMBODIMENTS

The present invention will now be described in detail with reference to the accompanying drawings.

Figure 1:
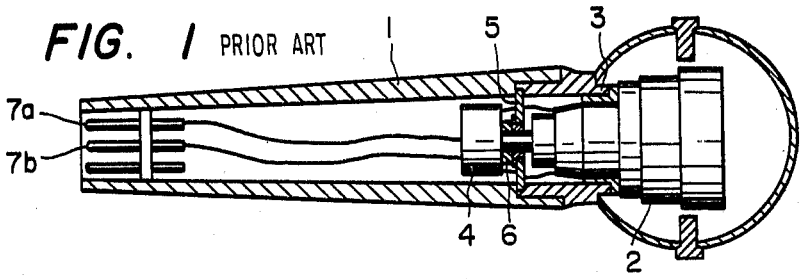
FIG. 1 PRIOR ART
FIG. 1 is a sectional view of a prior art dynamic microphone.
Figure 2:
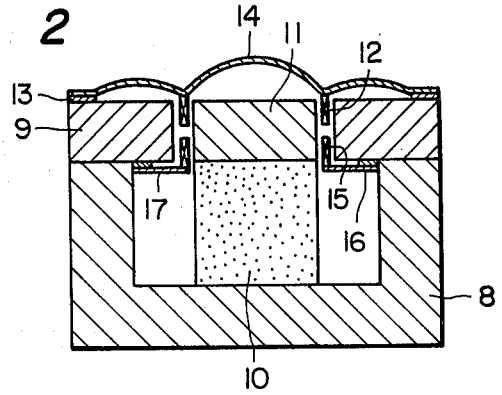
FIG. 2 is a sectional view of an embodiment of a magnetic circuit according to the present invention.

FIG. 2 is a sectional view of part of a magnetic circuit for a moving coil type microphone unit according to the present invention which is mounted in the casing of FIG. 1 in lieu of the UNIT 2. In this embodiment, an annular plate 9 is mounted on an outer face periphery of a cup-shaped yoke 8 and a magnet 10 is disposed in the interior of the cup-shaped yoke 8. A pole piece 11 is mounted on the magnet 10 so that the pole piece 11 forms a magnetic gap in association with the annular plate 9. In the magnetic gap, a voice coil 12 is positioned and is mounted on a vibrating diaphragm 14 fixed through a stationary ring 13 to the plate 9. The diaphragm 14, which is made of an aluminum film or synthetic resin film with a thickness of about 10$\mu$, is shaped in the form of dome so as to be capable of vibrating within a wide frequency range. When voice coil 12 vibrates, an induction voltage is generated.

Another voice coil 15 is positioned in the magnetic gap of the magnetic circuit of the above described device, the coil 15 forming a part of a vibrating pickup unit. The coil 15 is mounted on a vibratable suspension plate 17 fixed to the plate 9 through a suspension 16. The vibrating characteristics ($f_0$, Q and sensitivity) of the vibrating pickup unit composed of the the coil 15 and the suspension plate 17 are made to be the same as those of the above described microphone unit by suitable dimensioning of the relevant components.

The coil 15 moves in the magnetic gap in response to vibrations transmitted to the suspension plate 17 from the microphone case 1 (shown in FIG. 1) to thereby generate an induction voltage. The output voltage of the coil 15 is summed in opposite phase to the outputted voltage of the microphone unit so that both output voltages are equal to each other. Accordingly, it is possible to cancel the noise components.

The number of turns of the coil 15 is equal to that of the voice coil 12. In addition, the unit is constructed so that if an external magnetic flux is perpendicularly imposed upon the vibrating diaphragm 14, the induced voltages of the two coils are equal to each other. With such a technique, these voltages cancel electromagnetic interference.

Figure 3:
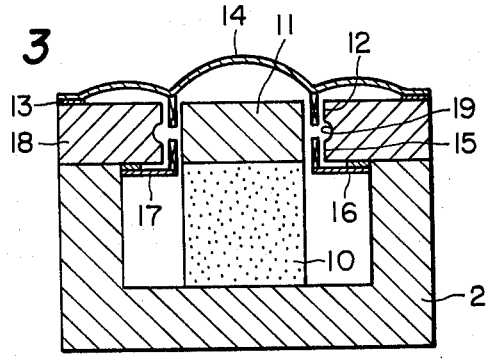
FIGS. 3 and 4 are sectional views of further embodiments of a magnetic circuit according to the present invention.

FIG. 3 is a view showing another embodiment of a magnetic circuit according to the present invention. In this embodiment, an annular recess portion 19 is formed in the inner wall face of the plate 18 to improve the magnetic efficiency in the vicinity of the voice coil 12. Except for this, the embodiment shown in FIG. 3 is the same as that shown in FIG. 2.

Figure 4:
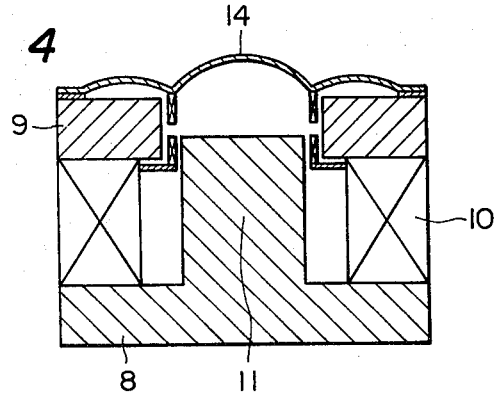

FIG. 4 shows a modification in which the magnetic circuit is of an outer magnet type. In this embodiment, the same reference numerals are used to indicate like components as in the previously-described embodiments.

In the above described emodiments, the diameters of the voice coils are the same for sound collecting and for vibration pickup. Therefore, the same number of coil winding turns must be used. However, to improve the sensitivity of the microphone, it is preferable that the coil impedance of the cancellation unit (the vibration pickup unit) be lower than that of the sound collecting unit (microphone unit). Namely, it is desired to use a wire material having relatively large diameter and a high induction efficiency.

As will be apparent from the foregoing description, by using a common magnetic circuit for the microphone unit and for the vibrating pickup unit, the necessary mechanical parts, as well as the costs, are reduced. In addition, noise component cancellation is provided over a wide frequency range. Furthermore, electromagnetic noise cancellation is also achieved.

What is claimed is:

1. A dynamic microphone comprising: a case; a moving coil type microphone unit sensitive to sound, said moving coil type microphone unit being positioned in said case; and a moving coil type vibration pickup unit sensitive to vibrations transmitted to said case, said moving coil type vibration pickup unit being positioned in and operatively coupled to said case, outputs of said microphone unit and said vibration pickup unit being coupled to each other in opposite phase to one another so that noise components corresponding to said vibrations transmitted to said case are cancelled, and said microphone unit and said vibration pickup unit having a common magnetic circuit.

2. A microphone as set forth in claim 1 wherein said vibration pickup unit is comprised of a suspension plate having a coil thereon operatively coupled to said case for vibration relative to said magnetic circuit.

3. A microphone as set forth in claim 1 wherein said microphone unit include a first voice coil having a first impedance coupled to a vibrating diaphragm and said vibration pickup unit includes a vibratable suspension plate coupled to a second voice coil having a second impedance, said second voice coil being positioned under said first voice coil.

4. A microphone as set forth in claim 1 wherein said magnetic circuit includes a magnet surrounded by a cup-shaped yoke.

5. A microphone as set forth in claim 1 wherein said magnetic circuit includes a yoke having a central core surrounded by a magnet.

6. A microphone as set forth in claim 3 wherein said second impedance is lower than said first impedance.

7. A dynamic microphone comprising: a cup-shaped yoke; a magnet disposed in an interior portion of said cup-shaped yoke; a pole piece positioned on a top of said magnet; an annular plate having an edge portion coupled to ends of said cup-shaped yoke, a magnetic gap being formed between an inner face of said annular plate and said pole piece; a first voice coil extending at least partially into an upper portion of said magnetic gap; a dome-shaped vibrating diaphragm coupled to an upper edge of said first voice coil; a stationary ring coupling peripheral portions of said vibrating diaphragm to an upper edge of said annular plate; a second voice coil extending at least partially into a lower portion of said magnetic gap; and damping suspension means supporting said second voice coil on said annular plate, outputs from said first and second voice coils being coupled together and in opposite phase to one another.

8. A dynamic microphone comprising: a yoke having a circular base and a cylindrical center post extending upwardly from said base; an annularly-shaped magnet affixed to an upper surface of said base of said yoke; an annular plate having a lower outer surface portion coupled to an upper surface of said magnet, a magnetic gap being formed between said post of said yoke and said annular plate; a first voice coil extending at least partially into an upper portion of said magnetic gap; a dome-shaped vibrating diaphragm coupled to an upper edge of said first voice coil; a stationary ring coupling peripheral portions of said vibrating diaphragm to an upper edge of said annular plate; a second voice coil extending at least partially into said magnetic gap; and resilient suspension means supporting said second voice coil on said annular plate, outputs of said first and second voice coils being coupled together and in opposite phase to one another.

9. The dynamic microphone of claim 7 or 8 wherein the number of turns of wire on said first voice coil is substantially equal to the number of turns of wire on said second voice coil.

10. The dynamic microphone of claim 7 or 8, wherein the number of turns of wire on said first voice coil is equal to the number of turns of wire on said second voice coil, and wherein said wire of said second voice coil has a larger diameter than said wire on said first voice coil.

11. The dynamic microphone of claim 7 or 8 wherein an annular recess is formed in an inner face of said annular plate.

* * * * *